US005795055A

United States Patent [19]

Shiao

[11] Patent Number: 5,795,055

[45] Date of Patent: Aug. 18, 1998

[54] COMBINED TOOL CASE AND FLASHLIGHT

[76] Inventor: Hsuan-Sen Shiao, No. 15-1, Lane 369, Min-Chuan Rd., Pei Dist., Taichung City, Taiwan

[21] Appl. No.: 972,716

[22] Filed: Nov. 18, 1997

[51] Int. Cl.[6] ..... A45C 15/06

[52] U.S. Cl. ..... 362/156; 362/154; 362/253; 362/398

[58] Field of Search ..... 362/109, 119, 362/154, 155, 156, 253, 234, 398

[56] References Cited

U.S. PATENT DOCUMENTS

| | | | |
|---|---|---|---|
| 690,753 | 1/1902 | McCormick | 362/156 |
| 4,149,223 | 4/1979 | Moberly | 362/156 |
| 5,685,421 | 11/1997 | Gilmore | 206/216 |

*Primary Examiner*—Stephen F. Husar
*Attorney, Agent, or Firm*—Banner & Witcoff, Ltd.

[57] ABSTRACT

A combined tool case and flashlight includes a tool case which has a housing portion and a cover portion that are hinged together and that respectively have first and second connecting ends forming complementing first and second cavity halves to confine a receiving space. A flashlight unit includes a cell housing, a bulb and a lamp shade mounted to the front end of the cell housing, and a joint portion formed integrally with the rear end of the cell housing. The joint portion projects rearwardly from the rear end into the receiving space. A magnet is provided in the rear end of the cell housing adjacent to the joint portion. The joint portion of the cell housing is prevented from being released from the tool case in a first direction toward the front end of the cell housing, and is releasable in a second direction perpendicular to the first direction. The second connecting end of the cover portion can push the joint portion in a third direction opposite to the second direction when the cover portion is closed. The flashlight offers light whenever necessary for tooling, and can be mounted on a suitable support or object by the magnet when the flashlight is separated from the tool case.

5 Claims, 5 Drawing Sheets

COMBINED TOOL CASE AND FLASHLIGHT

BACKGROUND OF THE INVENTION

1. Field of the Invention

This invention relates to a flashlight, more particularly to a combined tool case and flashlight which includes a flashlight coupled detachably to a tool case for convenience when used in dark places.

2. Description of the Related Art

Toolboxes are manufactured in order to store and carry tools. A portable light or a flashlight is indispensable when toolboxes are opened in dark places or where light is insufficient. It is desirable that a flashlight can be carried conveniently along with a toolbox as a standby accessory.

SUMMARY OF THE INVENTION

The object of the present invention is to provide a combined tool case and flashlight in which a flashlight is coupled with a tool case to offer light whenever necessary for tooling, wherein the flashlight incorporates a magnet for mounting on a suitable support or object when the flashlight is separated from the tool case.

According to this invention, a combined tool case and flashlight includes a tool case which has a housing portion, a cover portion hinged to the housing portion, and a fastener to fasten the cover portion to the housing portion. The housing and cover portions have first and second connecting ends formed respectively with first and second cavity halves that complement one another to confine a receiving space when the cover portion is closed. A flashlight unit includes a cell housing, a bulb which is mounted to the front end of the cell housing, a lamp shade to cover the bulb, and a joint portion which is formed integrally with the rear end of the cell housing. The joint portion projects rearwardly from the rear end into the receiving space. A magnet is provided on the rear end of the cell housing adjacent to the joint portion. The first connecting end of the housing portion and the joint portion of the cell housing have interlocking means which prevents release of the joint portion from the tool case in a first direction toward the front end of the cell housing and which permits a release movement of the joint portion in a second direction which is perpendicular to the first direction. The second connecting end of the cover portion has push means which pushes the joint portion in a third direction opposite to the second direction when the cover portion is closed.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
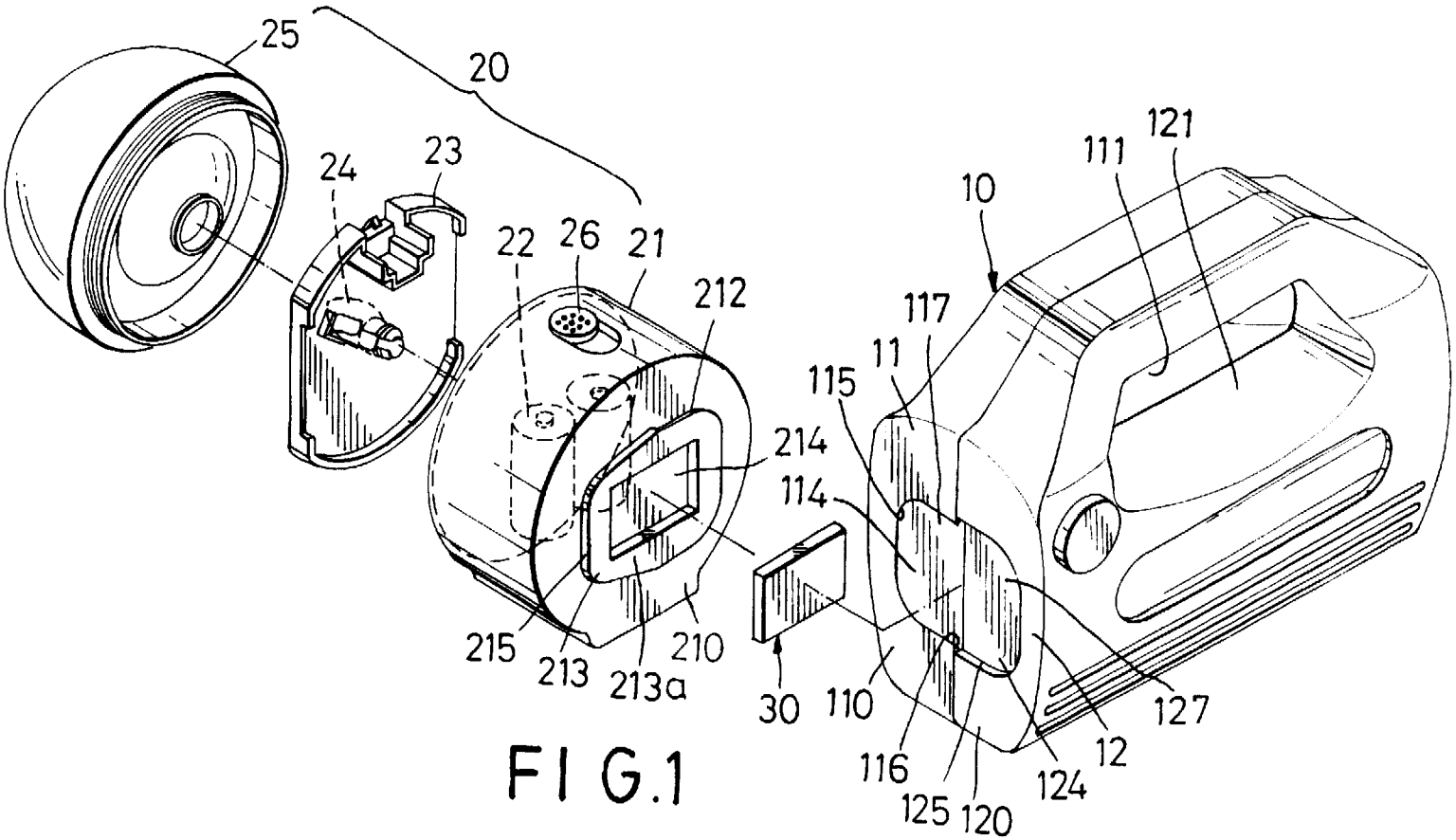
FIG. 1 is an exploded view of a preferred embodiment of a combined tool case and flashlight according to this invention.

Referring to FIG. 1, the preferred embodiment of a combined tool case and flashlight according to the present invention is shown to comprise a tool case 10, a flashlight unit 20 and a magnet 30.

Figure 2:
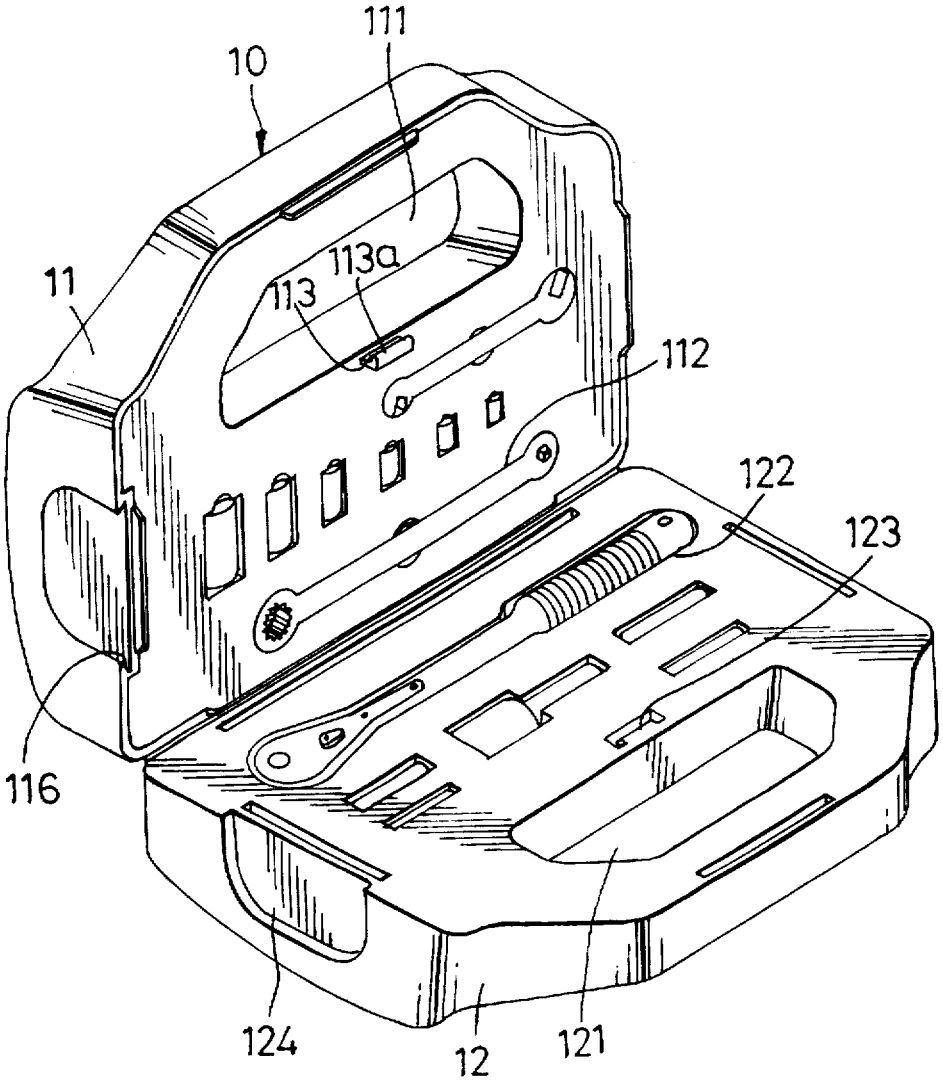
FIG. 2 is a perspective view showing a tool case of the embodiment of FIG. 1 in an open state.
Figure 4:
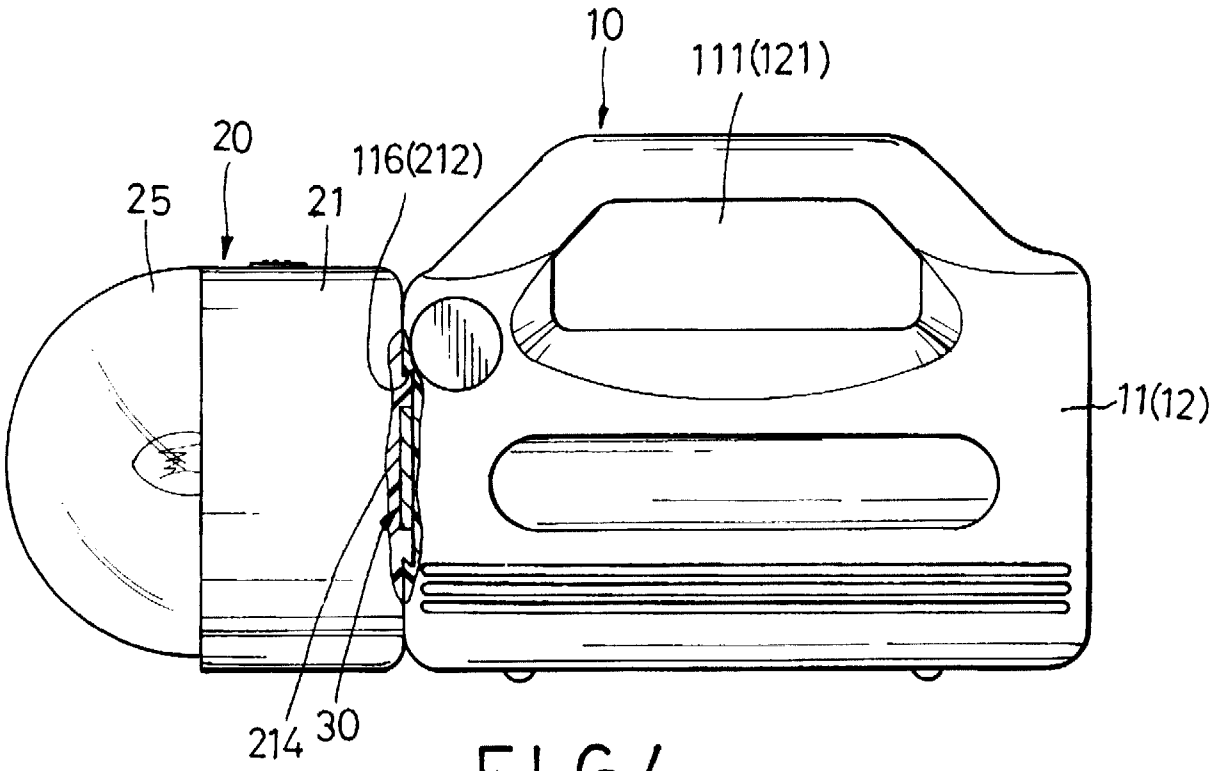
FIG. 4 is a side view which is partly sectioned to show how the tool case and the flashlight are interlocked.
Figure 5:
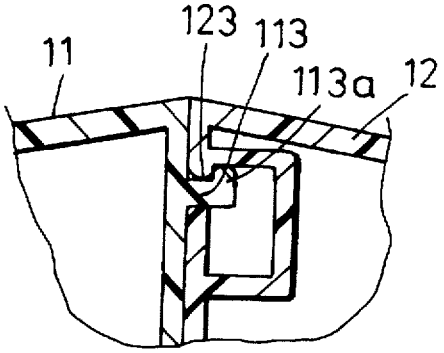
FIG. 5 is a sectional view of a portion of the tool case.

With reference to FIG. 2, the tool case 10 is made of plastic material, and generally includes a housing portion 11 and a cover portion 12 which is hinged to the housing portion 11 at bottom ends of the same. A plurality of tool receiving spaces 112, 122 are formed in the housing and cover portions 11, 12 for receiving tools. Handle halves 111, 121 are formed on the corresponding top ends of the housing and cover portions 11, 12. With reference to FIG. 5, a first lock member 113 of L-shaped cross-section projects from the housing portion 11 and has an engaging rib **113*a*. A second lock member 123 is formed on the cover portion 12 to engage the first lock member 113 in order to fasten the cover portion 12 to the housing portion 11. The housing and cover portions 11, 12 respectively have flat first and second connecting ends 110, 120 formed with first and second cavity halves 114, 124 that complement one another to confine a receiving space when the cover portion 12 is closed (see FIG. 1). The first connecting end 110 has a first wall half 115 and a first cavity end wall 117 which confine the first cavity half 114. The first wall half 115 has an engagement protrusion 116, as best shown in FIG. 4. The second connecting end 120 has a second wall half 125 and a second cavity end wall 127 which confine the second cavity half 124**.

The flashlight unit 20 includes a cell housing 21 which has an open front end and a closed rear end with a flat rear end face 210, a battery assembly 22 which is provided in the cell housing 21, a bulb seat 23 which is mounted at the front end of the cell housing 21 for mounting a bulb 24, and a lamp shade 25 which is connected to the front end of the cell housing 21 to cover the bulb 24, a switch 26 which is provided on the cell housing 21. The rear end of the cell housing 21 is formed integrally with a joint portion 213 which projects rearwardly therefrom. The joint portion 213 is formed as a projection of substantially rectangular cross-section with rounded corners, and has a flat projection end face **213*a* and a lateral surrounding wall which extends from the rear end face 210 to the projection end face 213*a*. The lateral surrounding wall forms a grooved locking portion 212 and a slide contact wall portion 215. The grooved locking portion 212 extends laterally along a first portion of the length of the lateral surrounding wall, and is indented inward. The slide contact wall portion 215 extends laterally along a second portion of the length of the lateral surrounding wall opposite the first portion. The joint portion 213 further has a recess 214 which opens at the projection end face 213*a* to receive the magnet 30 and which is closed by the first and second cavity walls 117, 127 when the flashlight 20 is connected to the tool case 10**.

Figure 3:
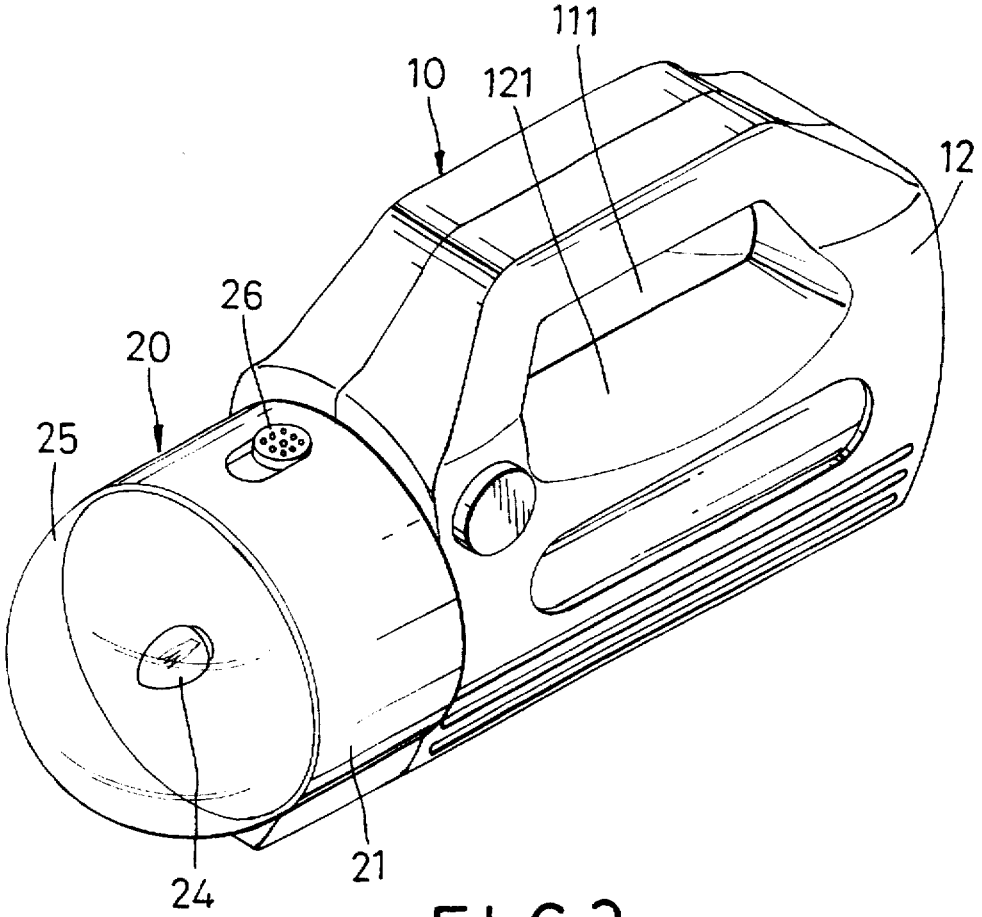
FIG. 3 is a perspective view of the combined tool case and flashlight according to the preferred embodiment.

Referring to FIGS. 3 and 4, the engagement between the grooved locking portion 212 and the engagement protrusion 116 can prevent the release of the joint portion 213 of the cell housing 21 from the tool case 10 in a first direction toward the front end of the cell housing 21. Thus, the flashlight unit 20 and the tool case 10 are interlocked via the grooved locking portion 212 and the engagement protrusion 116.

When the tool case 10 is opened by pushing the handle halves 111, 121 away from one another, the engaging rib **113*a* of the first lock member 113 passes over the second lock member 123. The second wall half 125 of the cover portion 12 slides over the slide contact wall portion 215 to release the former from the latter. When the flashlight unit 20 is to be removed from the tool case 10, the joint portion 213 of the cell housing 21 is moved in a second direction which is perpendicular to the first direction along which the joint portion 213 and the first connecting end 110 cannot engage one another to release the joint portion 213 from the first wall half 115. After the flashlight unit 20 is removed from the tool case 10, it can be attached to a metal object, such as a working machine, a car body, etc. by virtue of the attraction force of the magnet 30, and the tool case 10 can be used individually. When the flashlight unit 20** is mounted on a car body, it can be used as a signaling device in a dark place.

When the flashlight unit 20 is to be assembled onto the tool case 10, the tool case 10 is first opened, then the joint portion 213 is inserted in the first cavity half 114 of the housing portion 11 and is moved in a third direction opposite to the second direction to engage the first wall half 115. Subsequently, the cover portion 12 is moved to the housing portion 11 such that the second wall half 125 slides over the slide contact wall portion 215 of the joint portion 213 and pushes the joint portion 213 toward the first wall half 115. In this situation, the joint portion 213 of the flashlight unit 20 is prevented from moving in the first direction by virtue of the grooved locking portion 212 and the engagement protrusion 116 and in the second direction perpendicular to the first direction by virtue of the second wall half 125 of the cover portion 12. Therefore, the flashlight unit 20 is coupled firmly with the tool case 10.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A combined tool case and flashlight, comprising:

a tool case having a housing portion, a cover portion hinged to said housing portion, and a fastener to fasten said cover portion to said housing portion, said housing and cover portions having first and second connecting ends, respectively, said first and second connecting ends having first and second cavity halves which complement one another to confine a receiving space when said cover portion is closed;

a flashlight unit including a cell housing having opposite front and rear ends, a bulb mounted to said front end, a lamp shade connected to said front end to cover said bulb, and a joint portion formed integrally with said rear end of said cell housing, said joint portion projecting rearwardly from said rear end into said receiving space; and a magnet provided on said rear end of said cell housing adjacent to said joint portion;

said first connecting end of said housing portion and said joint portion of said cell housing having interlocking means which prevents release of said joint portion from said tool case in a first direction toward said front end of said cell housing and which permits a release movement of said joint portion in a second direction which is perpendicular to said first direction, said second connecting end of said cover portion having push means which pushes said joint portion in a third direction opposite to said second direction when said cover portion is closed.

2. The combined tool case and flashlight as claimed in claim 1, wherein said rear end of said cell housing has a rear end face, said joint portion of said cell housing being formed as a projection of substantially rectangular crosssection with rounded corners, said joint portion having a projection end face and a lateral surrounding wall extending from said rear end face to said projection end face, said lateral surrounding wall forming a grooved locking portion which extends laterally along a first portion of the length of said lateral surrounding wall and which is indented inward substantially in a direction perpendicular to said first direction, said lateral surrounding wall further forming a slide contact wall portion which extends laterally along a second portion of the length of said lateral surrounding wall substantially opposite said first portion.

3. The combined tool case and flashlight as claimed in claim 2, wherein said first connecting end of said housing portion further has a first wall half which confines said first cavity half, said first wall half having an engagement protrusion, said grooved locking portion and said engagement protrusion acting as said interlocking means, said second connecting end of said cover portion having a second wall half which confines said second cavity half, said second wall half sliding over said slide contact wall portion and pushing said joint portion toward said first wall half when said cover portion is closed.

4. The combined tool case and flashlight as claimed in claim 2, wherein said rear end face and said projection end face, and said first and second connecting ends of said tool case are flat.

5. The combined tool case and flashlight as claimed in claim 2, wherein said joint portion has a recess which opens at said projection end face to receive said magnet, said first and second connecting ends of said housing portion and said cover portion further having cavity end walls to close said recess when said cover portion is closed.

* * * * *